US007014412B2

(12) United States Patent
Daniel

(10) Patent No.: US 7,014,412 B2
(45) Date of Patent: Mar. 21, 2006

(54) FORK AND JAW GRAPPLE

(75) Inventor: Timothy E. Daniel, Carlock, IL (US)

(73) Assignee: Daniel Manufacturing Inc., Carlock, IL (US)

( * ) Notice: Subject to any disclaimer, the term of this patent is extended or adjusted under 35 U.S.C. 154(b) by 26 days.

(21) Appl. No.: 10/840,005

(22) Filed: May 6, 2004

(65) Prior Publication Data

US 2004/0223838 A1 Nov. 11, 2004

Related U.S. Application Data

(60) Provisional application No. 60/468,315, filed on May 6, 2003.

(51) Int. Cl.
*B66C 3/00* (2006.01)

(52) U.S. Cl. ..... 414/729; 414/724; 414/912; 37/406

(58) Field of Classification Search ..... 414/729, 414/724, 912; 37/406, 903
See application file for complete search history.

(56) References Cited

U.S. PATENT DOCUMENTS

| | | | | |
|---|---|---|---|---|
| 4,529,239 | A | 7/1985 | Ogawa | 294/88 |
| 5,518,359 | A * | 5/1996 | Pratt | 414/724 |
| 6,131,978 | A | 10/2000 | Rounds | 294/106 |
| 6,176,531 | B1 | 1/2001 | Wheeler | 294/88 |
| 6,257,636 | B1 | 7/2001 | Hovis et al. | 294/110.1 |
| 6,287,072 | B1 | 9/2001 | Wasilas | 414/729 |
| 6,357,993 | B1 * | 3/2002 | Burton | 414/724 |
| 6,457,761 | B1 | 10/2002 | Benoit | 294/84.41 |
| 6,589,007 | B1 | 7/2003 | Burton | 414/724 |
| 6,601,891 | B1 | 8/2003 | Gregory, Jr. | 294/88 |
| 6,722,843 | B1 | 4/2004 | Mensch | 414/740 |
| 6,820,357 | B1 * | 11/2004 | Menard et al. | 37/403 |
| 2003/0031547 | A1 | 2/2003 | Stumvoll et al. | 414/723 |

OTHER PUBLICATIONS

Bradco, A Division of ATI GLOBAL, Inc., *Grapple Buckets*, Features & Benefits, Specifications, May 1997.
Farmer's Factory Co., Product Sheet, *Scrap Grapple Bucket*, Features and Specifications, Attachments.
Bobcat, *Attachments for Loaders/Excavators*, Bobcat Attachments for Loaders.
Case, *1800 Series Skid Steers*, Case Models 1840 and 1845C, p. 14.
Equipment Today, *Big Machine Performance From Compacts*, Skid Steer Slab Crab, pp. 156-157, Mar. 2002.
Equipment Today, *Take Control of Excavator Costs*, Attachment Guide, pp. 96-98, 116-118, 180, 183, 207, 221, Jan. 2002.

* cited by examiner

*Primary Examiner*—Donald W. Underwood
(74) *Attorney, Agent, or Firm*—Husch & Eppenberger, LLC; David A. Chambers; Robert C. Haldiman

(57) ABSTRACT

A fork and jaw grapple having two forks and a jaw for wedging under, prying up, gripping, moving and handling materials. The forks have tips with angles for prying between and under materials. The jaw being a hydraulically actuated upper jaw that moves about a pivot point via a cylinder for grabbing, gripping and holding materials during pick-up, transport and place down.

24 Claims, 7 Drawing Sheets

FORK AND JAW GRAPPLE

CROSS-REFERENCE TO RELATED APPLICATIONS

This application claims priority from U.S. Provisional Patent Application No. 60/468,315 filed May 6, 2003.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

The present invention relates generally to a device for gripping, moving and handling materials and, more particularly, to a fork and jaw grapple for operatively attaching to a skid steer loader or other equipment.

2. Related Art

It is known to provide various grapple attachments for securing to skid steer loaders and other equipment. Grapple buckets, slab grabbers, grapple rakes, industrial grapples, box rakes, landscape rakes, power rakes, land planes, planers, demolition attachments, quick-tach grapples, jack buckets, shaker buckets, scrap grapples, pallet forks, root grapples, brooms, back fillers, chippers and snow blades are examples of various attachments for skid steer loaders. A significant disadvantage with these attachments is that the attachments are designed for a very specific purpose and are not multi-functional.

An owner of a skid steer loader desires an attachment that is multi-functional. For example, an owner may use a skid loader to, among other things, lift and transport 55-gallon drums; to scoop, lift, transport and dump sod; and to lift, transport and dump logs, telephone poles or slabs of concrete. A single attachment could not perform all of these tasks efficiently and effectively. The cost for purchasing an attachment for each task is prohibitive. It would be much more beneficial to have an attachment for perform multiple tasks, such as lifting and transporting logs, pipes, boards, tires, stumps, concrete slabs, rocks, scrap metal, barrels and other materials.

Moreover, storing multiple attachments is not desirable because of the storage area required to store these attachments. Additionally, leaving the attachments outside significantly reduces the performance and life of the attachments.

The process of removing concrete slabs from sidewalks, foundations, flooring or other areas (hereinafter collectively "concrete slabs") is problematic. First, the concrete slabs need to be pried loose from the ground surface. This is not easily done because the attachments available for a skid steer loader are not designed for this purpose. Most attachments are bucket shaped and too big and awkward to efficiently remove concrete.

The process of placing materials into a dump truck or other vehicles with a skid steer loader is also problematic because the attachments drop the materials into the back of the dump truck. For example, concrete slabs that are pried loose and picked up with the bucket attachment of a skid steer loader have to be dropped into the dump truck. Dropping heavy pieces of materials into the back of a dump truck creates significant safety risks and causes damage to the dump truck. Moreover, if the operator of the dump truck owns the rig, the operator may become agitated and angry when heavy loads are dumped into the back of the dump truck. There is a need for an attachment that can place various materials into the back of a dump truck.

Using a skid steer loader to place materials into a dump truck without damaging the materials is problematic. For example, piping that cannot be dented or damaged is usually dropped from the bucket attachment of a skid steer loader into the back of a dump truck. The probability of damaging materials that are dropped into a dump truck is high.

The present invention is directed to overcoming one or more of the problems set forth above.

SUMMARY OF THE INVENTION

An aspect of the present invention is to provide an apparatus for overcoming one or more of the problems set forth above.

Another aspect of the invention is to provide a fork and jaw grapple that efficiently pries loose concrete slabs.

In another aspect of the invention there is provided a fork and jaw grapple that holds and transports concrete slabs and places the concrete slabs into a desired location, such as the back of a dump truck, without dropping said materials.

In one aspect of this invention there is provided a multi-purpose grapple for performing multiple tasks including but not limited to lifting and transporting logs, pipes, boards, tires, stumps, concrete slabs, rocks, scrap metal, barrels and other materials and placing the materials in a desired location without dropping said materials.

In still another aspect of this invention there is provided a multi-purpose grapple for performing multiple tasks including but not limited to placing logs, pipes, boards, tires, stumps, concrete slabs, rocks, scrap metal, barrels and other materials in a desired location without dropping to avoid damaging said materials.

In yet another aspect of the invention there is provided a multi-purpose grapple for performing multiple tasks including but not limited to placing logs, pipes, boards, tires, stumps, concrete slabs, rocks, scrap metal, barrels and other materials into a device, such as the back of a dump truck, without damaging said device.

These, and other aspects and advantages of the present invention, will become apparent from the following detailed description. The above listing of aspects of the invention should not be deemed as all-inclusive in any manner whatsoever.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 5:
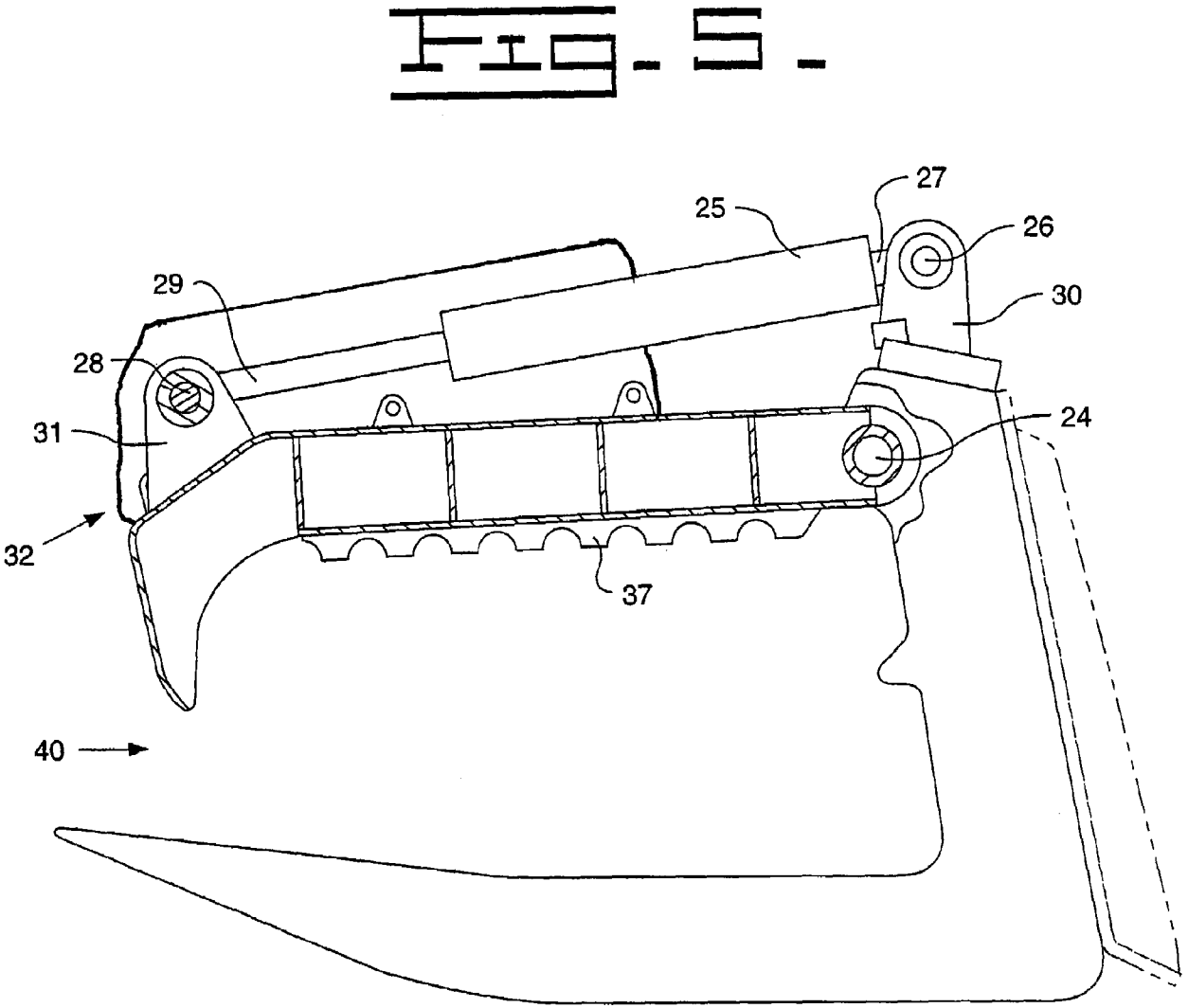
FIG. 5 is a side view of the fork and jaw grapple showing a cross-sectional view of the jaw according to 5—5 of FIG. 3.
Figure 6:
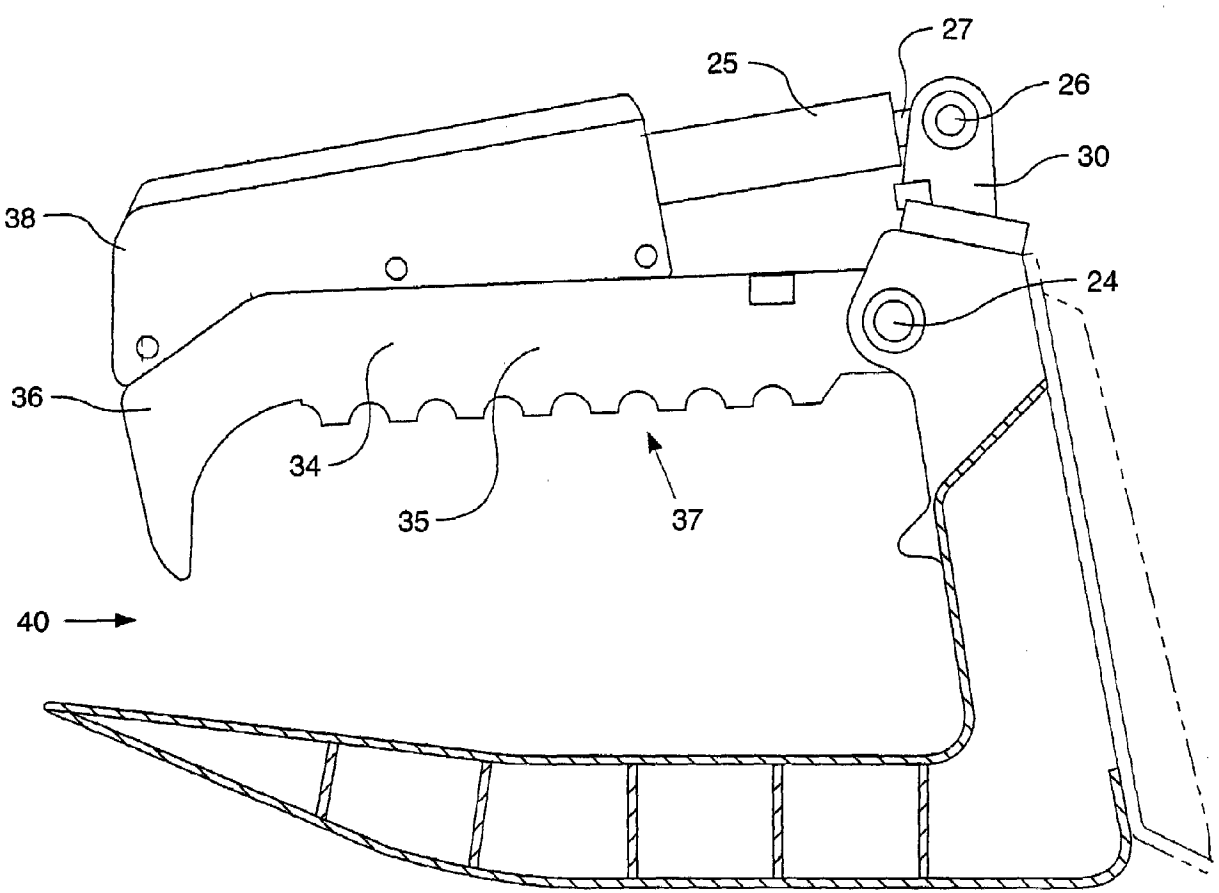
FIG. 6 is a side view of the fork and jaw grapple showing a cross-sectional view of the fork according to 6—6 of FIG. 3.
Figure 7:
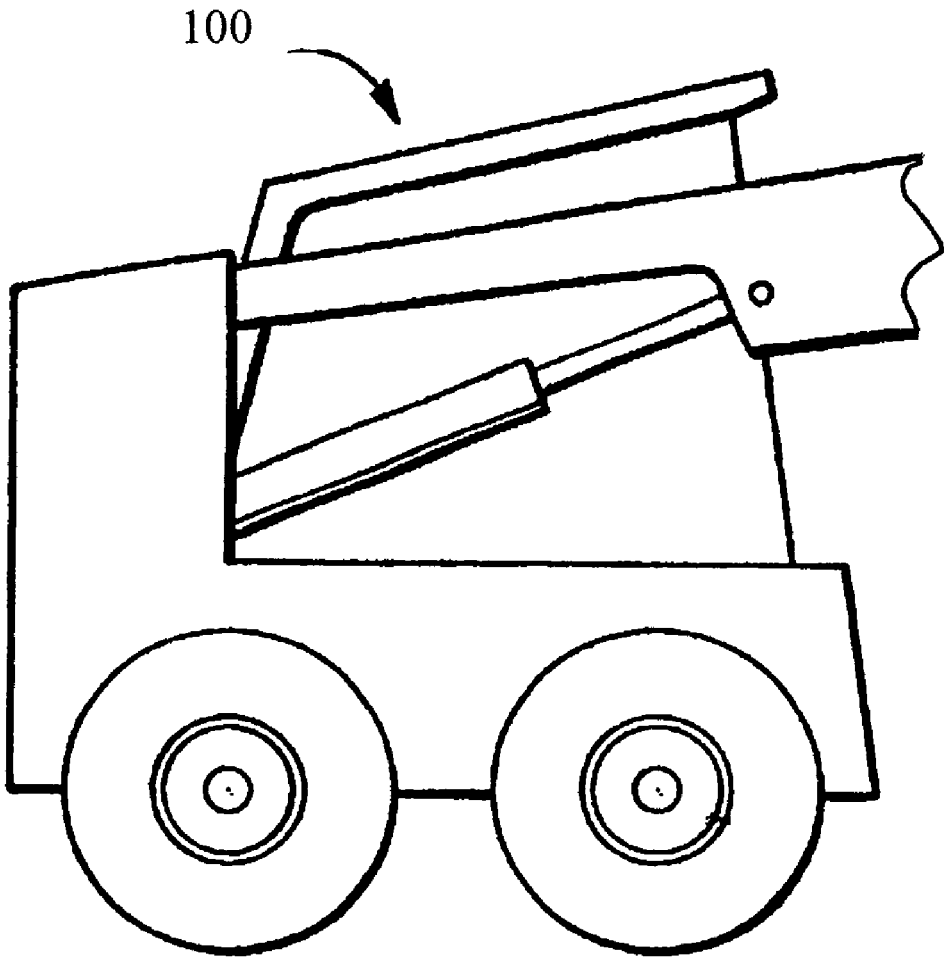
FIG. 7 is a side view of a skid steer loader.

Referring to the accompanying drawings in which like reference numbers indicate like elements, FIGS. 1–6 illustrate a fork and jaw grapple 10 for use on a vehicle, for example a skid steer loader 100 (see FIG. 7). The fork and jaw grapple 10 has two forks 11 and a jaw 12. In alternative embodiments, there could be additional forks 11 and jaws 12. The forks 11 and jaw 12 are made from high strength steel. Tips 13 of the forks 11 are preferably made of high carbon steel.

Figure 1:
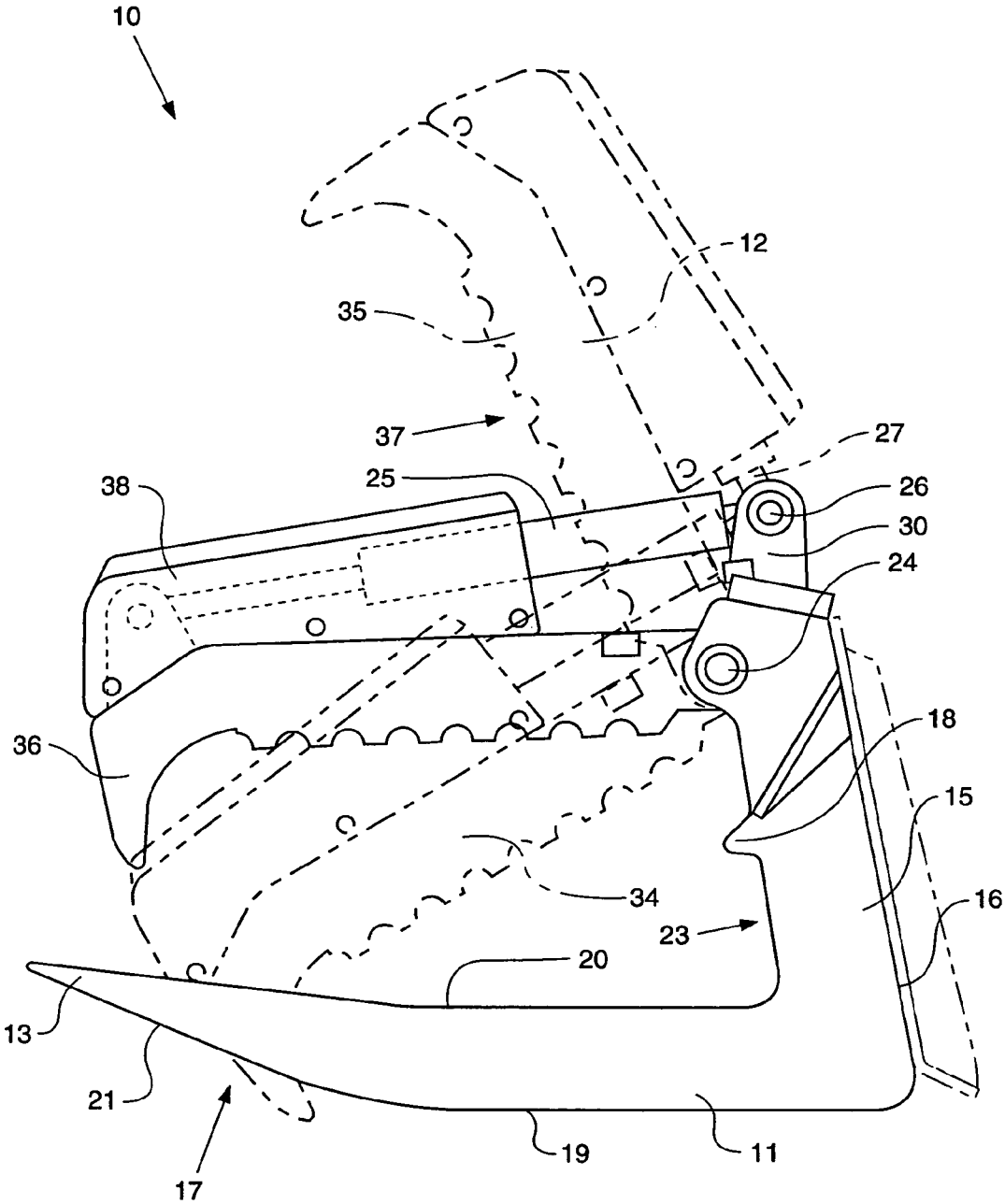
FIG. 1 is a side view of a fork and jaw grapple according to the present invention.
Figure 2:
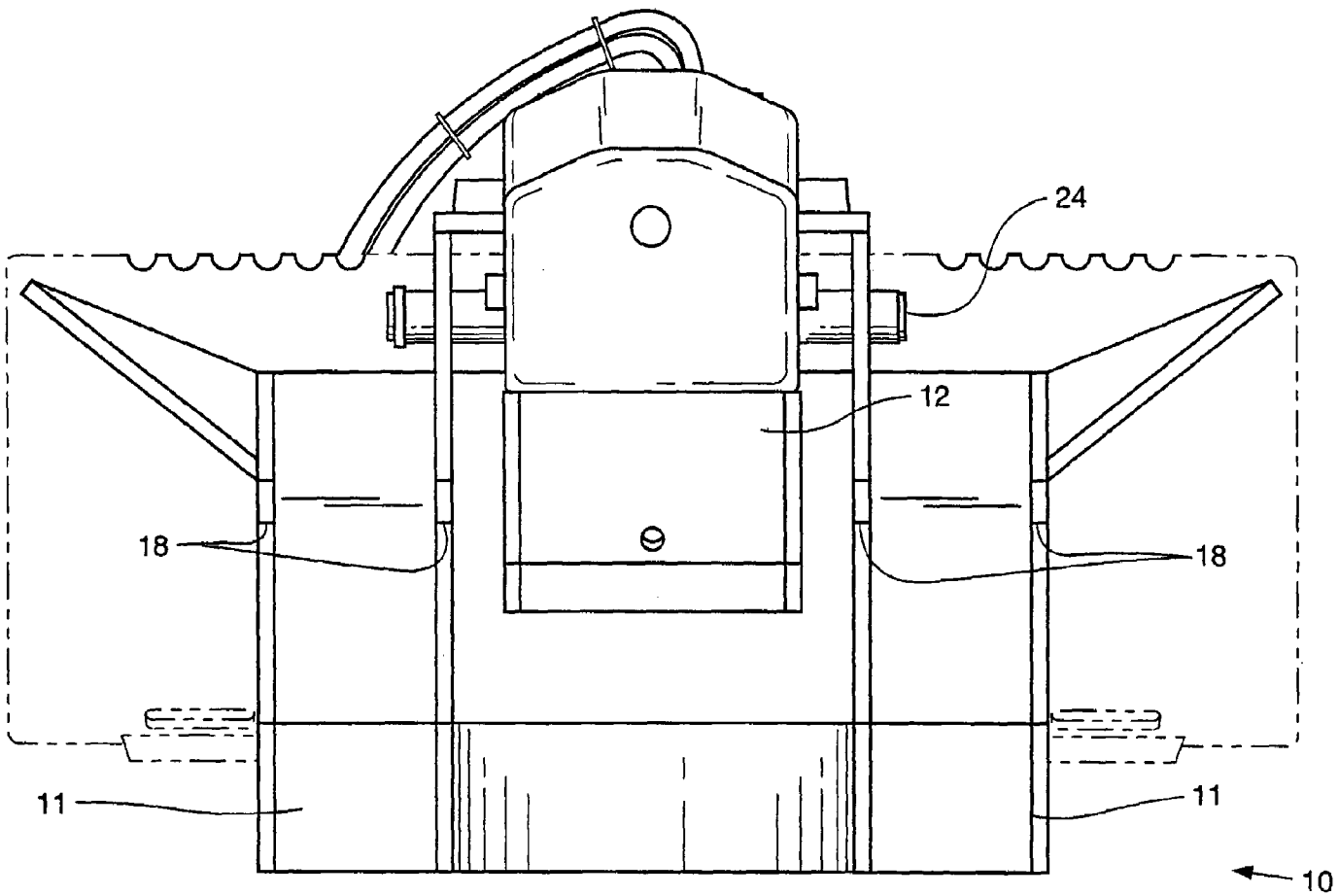
FIG. 2 is a front view of the fork and jaw grapple according to FIG. 1.
Figure 3:
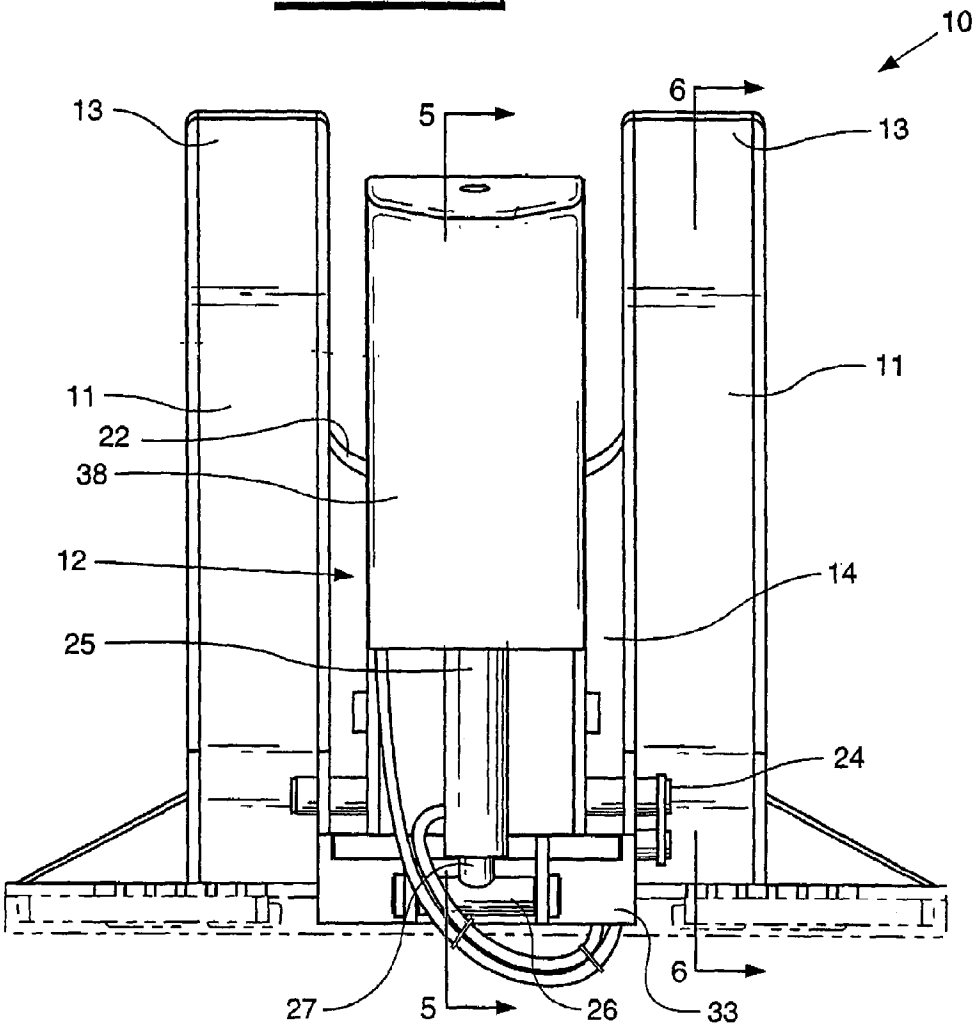
FIG. 3 is a top view of the fork and jaw grapple according to FIG. 1.
Figure 4:
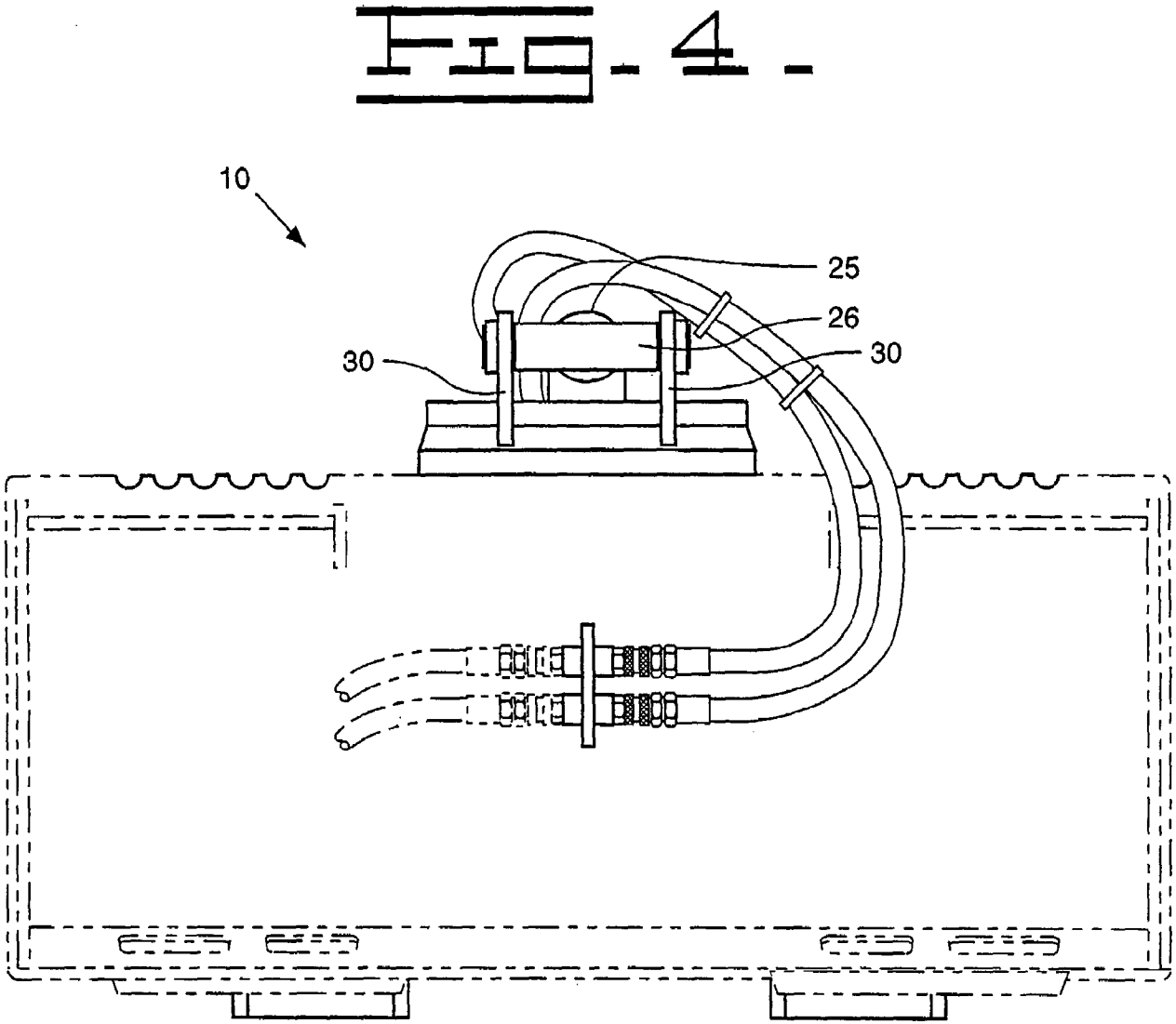
FIG. 4 is a back view of the fork and jaw grapple according to FIG. 1.

In the depicted embodiment, the forks 11 are L-shaped and operatively attached to each other via a middle section 14. The forks 11 are preferably spaced thirteen and one-eight (13⅛th) inches apart from each other and have a width from outer edge to outer edge of twenty-six (26) inches. In the fork and jaw grapple's 10 resting position as shown in FIGS. 1, 5 and 6, the forks 11 extend parallel with a horizontal plane for approximately seventeen and one-half (17½) inches from back surfaces 16 of upward extending members 15 of the forks 11. Thereafter, the forks 11 have curvatures 17 which are used for prying and getting under heavy objects. The curvatures 17 extend approximately eighteen and one-half (18½) inches. There is a twenty-two (22°) degree angle between a tapered portion 21 of the forks 11 and horizontal plane or bottom surfaces 19 of the forks 11. The back surfaces 16 of the upward extending members 15 are eighty-three (83°) degrees from the bottom surfaces 19 of the forks 11. The forks 11 are thirty-six (36) inches in length from the back surfaces 16 of the upward extending members 15 to ends of the forks 11. Each of the upward extending members 15 have at least one stop 18 for precluding upward movement of objects being carried or moved by the fork and jaw grapple 10. The stops 18 are approximately six and three-fourths (6¾th) inches from top surfaces 20 of the forks 11. The curvatures 17 and shape of the forks 11 magnify the "breakout" or upward force that can be exerted by the fork and jaw grapple 10. This is significant because a skid steer loader is limited in the amount of upward force it can apply on an object. The width of the fork and jaw grapple 10 is narrower than a full-length or width bucket attachment commonly used on a skid steer loader so that the forks 11 are within the width of concrete slabs to facilitate the prying up and carrying of concrete slabs. The narrowness of the fork and jaw grapple 10 is important, significant and advantageous over a full-length or width bucket attachment because it concentrates the limited effort of the skid steer loader in front of and close to the center line of the machine. Moreover, the narrower width allows the skid steer loader to maneuver in tight spots. For example, the skid steer loader with the fork and jaw grapple 10 attached thereto enables the operator to steer or track straight in and out in-line with a slab of concrete for a sidewalk. This allows efficient removal of concrete slabs with minimal disruption to the surroundings. In contrast, when a full-length or width bucket is used to removed a slab of concrete from a sidewalk, the corner of a bucket would be used to pry up the slab which commonly leads to equipment failure and defect and significant disruption of the surrounding soil and concrete. As examples, the fork and jaw grapple 10 may have a width less than the width of a machine frame, a width less than four feet, or a width less than three feet. It should be noted that the previously described dimensions of the fork and jaw grapple 10 are beneficial for maneuvering, prying up and carrying concrete slabs and other materials; however, the dimensions may be varied.

The middle section 14 is L-shaped and operatively connected between the forks 11. The middle section 14 terminates on the horizontal plane with a U-shaped section 22. The U-shaped section 22 is preferable over other shapes because it is free of pinch points and will not grab the materials or objects being lifted. In the preferred embodiment, the middle section 14 terminates approximately twelve (12) inches from a front surface 23 of the upward extending members 15.

Referring now to FIGS. 1, 5 and 6, the jaw 12 is a hydraulically actuated upper jaw and moves about a pivot point 24 via a cylinder 25. The jaw 12 has a range of motion about the pivot point 24. The jaw 12 has an arm 34 having a straight portion 35 and a curved end 36. The curved end 36 curves downwardly when in the resting position. The curved end 36 facilitates the grabbing or holding of materials or objects and precludes materials or objects from slipping out of the fork and jaw grapple 10 during transport. The jaw 12 moves about the pivot point 24 and provides a holding or clamping force on materials or objects. The straight portion 35 of the arm 34 has fingers 37 for gripping and holding materials or objects.

The cylinder 25 has a three (3) inch bore diameter and twelve (12) inch stroke length. The cylinder 25 is housed in a shroud 38 to protect it from damage during use and inclement weather. The cylinder 25 has a first end 27 operatively connected to a first horizontal pin 26, and a second end 29 operatively connected to a second horizontal pin 28. The first horizontal pin 26 is rotatably mounted to a back mounting bracket 30, and the second horizontal pin 28 is rotatably mounted to a front mounting bracket 31. The front mounting bracket 31 is operatively mounted to a front, top end 32 of the jaw 12. The back mounting bracket 30 is operatively attached to the middle section 14 at a top portion 33. The pivot point 24 of the jaw 12 is offset from the first horizontal pin 26 of the cylinder 25 in the vertical and horizontal axis, and the second horizontal pin 28 is offset from the pivot point 24 and the first horizontal pin 26 in the vertical and horizontal axis such that when the cylinder extends and retracts, the jaw 12 rotates about the first horizontal pin 26 as indicated by the phantom lines in FIG. 1. Specifically, as the second end 29 of the cylinder 25 extends, the jaw 12 moves or pivots about the pivot point 24 in the downward direction towards the forks 11, and as the second end 29 of the cylinder 25 retracts, the jaw 12 moves or pivots about the pivot point 24 in the upward direction away from the forks 11.

In use, the skid steer loader can move the fork and jaw grapple 10 in the vertical and horizontal direction. In addition, the skid steer loader can move the fork and jaw grapple 10 from its resting position shown in FIGS. 1, 5 and 6 approximately ninety (90°) degrees clockwise or ninety (90°) degrees counterclockwise.

In one such use, the fork and jaw grapple 10 can be used to pry concrete slabs upward away from the ground without removing a significant amount of sod. When above the concrete slab to be removed, the fork and jaw grapple 10 is rotated ninety (90°) degrees counterclockwise or downward so that a mouth 40 of the fork and jaw grapple 10 is pointing downward toward the concrete slab. Thereafter, the forks 11 of the fork and jaw grapple 10 wedge between concrete slabs and are then the fork and jaw grapple 10 is rotated ninety (90°) clockwise or upward and slid under the concrete slab to pry it from the ground. The angle at the tips 13 of the forks 11 and the forces being applied by the skid steer loader and the fork and jaw grapple 10 facilitate the "breakout" or prying away of the concrete slab from the ground. The fork and grapple 10 is able to remove concrete slabs without removing a significant amount of sod, which is in contrast to the bucket attachment which removes a large amount of sod when performing the same operation. The fork and jaw grapple 10 is then used to fully slip the forks 11 under the concrete slab at which time the second end 29 of the cylinder 25 is extended causing the jaw 12 to move downward into engagement and to hold or grab the concrete slab. The stops 18 prevent the concrete slab from moving upward past the stops 18. The fork and jaw grapple 10 is then used to pick-up and transport the concrete slab to a dump truck, other vehicle or location for place down into the back of the dump truck, other vehicle or location as opposed to dumping the concrete slab into the back of the dump truck, other vehicle or location. When above the back of the dump truck, other vehicle or location, the fork and jaw grapple 10 is rotated ninety (90°) degrees counterclockwise or downward so that the mouth 40 of the fork and jaw grapple 10 holding or grasping the concrete slab is pointing downward. Thereafter, the fork and jaw grapple 10 places the concrete slab in contact with the back of the dump truck, other vehicle or location, and the second end 29 of the cylinder 25 retracts thereby opening the jaw 12 to release the concrete slab. Because the concrete slab is not dumped or dropped, the dump truck or other vehicle is not damaged.

In other uses, the fork and jaw grapple 10 is slid under or into materials, such as telephone poles, pipes, posts, railroad ties, tires, scrap piles or other materials or objects. The angle at the tips 13 of the forks 11 and the forces being applied by the skid steer loader and the fork and jaw grapple 10 facilitate the insertion under or into the materials. After insertion under or into these materials, the second end 29 of the cylinder 25 is extended thereby moving the jaw 12 downward into engagement and to hold the materials during pick-up, transport or placement down. The fork and jaw grapple 10 is then used to pick-up and transport the materials to a dump truck, other vehicle or location for placing down, as opposed to dumping the materials. When above the back of the dump truck, other vehicle or location, the fork and jaw grapple 10 is rotated ninety (90°) degrees counterclockwise or downward so that the mouth 40 of the fork and jaw grapple 10 holding or grasping the materials is pointing downward. Thereafter, the fork and jaw grapple 10 places the materials in contact with the back of the dump truck, other vehicle or location, and the second end 29 of the cylinder 25 retracts thereby opening the jaw 12 to release the materials. Because the materials are not dumped or dropped, the materials are not damaged during handling.

In other uses, the fork and jaw grapple 10 slides under, grabs or holds (as previously explained) and lifts rocks, barrels, tires and other similar objects. Thereafter, the fork and jaw grapple 10 places the object in contact with the back of the dump truck, or other location, and the second end 29 of the cylinder 25 retracts thereby opening the jaw 12 to release the object.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, while in the depicted embodiments there is a single upper jaw, those skilled in the art will understand that the fork and jaw grapple may include two or more upper jaws. Thus, the breadth and scope of the present invention should not be limited by any of the above-described exemplary embodiments, but should be defined only in accordance with the following claims appended hereto and their equivalents.

What is claimed is:

1. A fork and grapple attachment for a machine, the fork and jaw grapple attachment comprising:

a. a first lower fork, said first lower fork having a longitudinally extending member, an upwardly extending back member transverse to said longitudinally extending member, an arcuate portion located at an end portion of said longitudinally extending member, and a tapered portion operatively connected to said arcuate portion such that said arcuate portion provides a fulcrum point and said longitudinally extending member provides a lever for mechanical advantage;

b. a second lower fork spaced apart from said first lower fork, said second lower fork having a longitudinally extending member, an upwardly extending back member transverse to said longitudinally extending member, an arcuate portion located at an end portion of said longitudinally extending member, and a tapered portion operatively connected to said arcuate portion such that said arcuate portion provides a fulcrum point and said longitudinally extending member provides a lever for mechanical advantage;

c. a middle section rigidly connected to said first lower fork and to said second lower fork;

d. an upper jaw pivotably connected to said upwardly extending back members of said first lower fork and said second lower fork, said upper jaw located intermediate to said first lower fork and said second lower fork, and said upper jaw including an arm having an arcuate end portion at a distal end of said arm; and e. a hydraulic cylinder operatively connected to said upper jaw, said hydraulic cylinder adapted to pivot said upper jaw relative to said first lower fork and said second lower fork.

2. The fork and jaw grapple according to claim 1, wherein said first lower fork, said second lower fork and said upper jaw are all comprised of steel.

3. The fork and jaw grapple according to claim 1, wherein said first lower fork and said second lower fork are L-shaped.

4. The fork and jaw grapple according to claim 1, further comprising a stop operatively connected to said first lower fork or to said second lower fork.

5. The fork and jaw grapple according to claim 1, wherein said middle section is L-shaped.

6. The fork and jaw grapple according to claim 1, wherein said middle section terminates with a U-shaped section.

7. The fork and jaw grapple according to claim 1, wherein said arm includes a plurality of fingers.

8. The fork and jaw grapple according to claim 1, further comprising a shroud operatively connected to said upper jaw.

9. The fork and jaw grapple according to claim 1, further comprising a back mounting bracket operatively connected at least to said first lower fork or to said second lower fork.

10. The fork and jaw grapple according to claim 1, further comprising a front mounting bracket operatively connected to said upper jaw.

11. The fork and jaw grapple according to claim 1, further comprising at least one tip operatively connected to one of said tapered portions.

12. The fork and jaw grapple according to claim 11, where in said at least one tip is comprised of high carbon steel.

13. A fork and grapple attachment for a machine, the machine having a machine frame, the fork and jaw grapple attachment comprising:

a. a first lower fork, said first lower fork having a longitudinally extending member, an upwardly extending back member transverse to said longitudinally extending member, an arcuate portion located at an end portion of said longitudinally extending member, and a tapered portion operatively connected to said arcuate portion such that said arcuate portion provides a fulcrum point and said longitudinally extending member provides a lever for mechanical advantage;

b. a second lower fork spaced apart from said first lower fork, said second lower fork having a longitudinally extending member, an upwardly extending back member transverse to said longitudinally extending member, an arcuate portion located at an end portion of said longitudinally extending member, and a tapered portion operatively connected to said arcuate portion such that said arcuate portion provides a fulcrum point and said longitudinally extending member provides a lever for mechanical advantage;

c. a middle section rigidly connected to said first lower fork and to said second lower fork;

d. an upper jaw pivotably connected to said first lower fork and to said second lower fork, said upper jaw including an arm having an arcuate end portion at a distal end of said arm;

e. a hydraulic cylinder operatively connected to said upper jaw; and f. wherein a width between an outside edge of said first lower fork and an outside edge of said second lower fork is dimensioned for operative engagement with a slab of concrete for a sidewalk.

14. The fork and jaw grapple according to claim 13, wherein said width is twenty-six inches.

15. The fork and jaw grapple according to claim 13, wherein said width is dimensioned such that the slab of concrete can be removed from the ground without disrupting a significant amount of sod adjacent the concrete slab.

16. A skid steer loader having a machine frame, the skid steer loader comprising:

a. an attachment, said attachment comprising:

i. a first lower fork, said first lower fork having a longitudinally extending member, an upwardly extending back member transverse to said longitudinally extending member, an arcuate portion located at an end portion of said longitudinally extending member, and a tapered portion operatively connected to said arcuate portion;

ii. a second lower fork spaced apart from said first lower fork, said second lower fork having a longitudinally extending member, an upwardly extending back member transverse to said longitudinally extending member, an arcuate portion located at an end portion of said longitudinally extending member, and a tapered portion operatively connected to said arcuate portion;

iii. a middle section rigidly connected to said first lower fork and to said second lower fork;

iv. an upper jaw pivotably connected to said first lower fork and to said second lower fork, said upper jaw including an arm having an arcuate end portion at a distal end of said arm;

v. a hydraulic cylinder operatively connected to said upper jaw; and vi. wherein a width between an outside surface of said first lower fork and an outside surface of said second lower fork is less than the width of the machine frame.

17. The skid steer loader according to claim 16, wherein said width is less than four feet.

18. The skid steer loader according to claim 17, wherein said width is less than three feet.

19. A method of assembling fork and jaw grapple, the comprising the steps of:

a. providing a first lower fork, said first lower fork having a longitudinally extending member, an upwardly extending back member transverse to said longitudinally extending member, an arcuate portion located at an end portion of said longitudinally extending member, and a tapered portion operatively connected to said arcuate portion;

b. locating a second lower fork spaced apart from said first lower fork such that a width between an outside edge of said first lower fork and an outside edge of said second lower fork is dimensioned for operative engagement with a slab of concrete for a sidewalk, said second lower fork having a longitudinally extending member, an upwardly extending back member transverse to said longitudinally extending member, an arcuate portion located at an end portion of said longitudinally extending member, and a tapered portion operatively connected to said arcuate portion;

c. rigidly connecting a middle section to said first lower fork and to said second lower fork;

d. pivotably connecting an upper jaw to said first lower fork and to said second lower fork, said upper jaw including an arm having an arcuate end portion at a distal end of said arm; and e. operatively connecting a hydraulic cylinder to said upper jaw.

20. A method of use for a fork and jaw grapple, the method comprising the steps of:

a. providing a fork and jaw grapple, said fork and jaw grapple comprising:

i. a first lower fork, said first lower fork having a longitudinally extending member, an upwardly extending back member transverse to said longitudinally extending member, an arcuate portion located at an end portion of said longitudinally extending member, and a tapered portion operatively connected to said arcuate portion;

ii. a second lower fork spaced apart from said first lower fork, said second lower fork having a longitudinally extending member, an upwardly extending back member transverse to said longitudinally extending member, an arcuate portion located at an end portion of said longitudinally extending member, and a tapered portion operatively connected to said arcuate portion;

iii. a middle section rigidly connected to said first lower fork and to said second lower fork;

iv. an upper jaw pivotably connected to said first lower fork and to said second lower fork, said upper jaw including an arm having an arcuate end portion at a distal end of said arm;

v. a hydraulic cylinder operatively connected to said upper jaw; and vi. wherein a width between an outside surface of said first lower fork and an outside surface of said second lower fork is dimensioned for operative engagement with a slab of concrete for a sidewalk;

b. moving the fork and jaw grapple toward the slab of concrete;

c. engaging said first lower fork and said second lower fork with a bottom side of the slab of concrete;

d. prying upwardly the slab of concrete;

e. engaging said upper jaw with the slab of concrete; and f. lifting upwardly the slab of concrete.

21. The method of use according to claim 20, further comprising the step of placing the concrete slab into a back of a vehicle.

22. The fork and jaw grapple according to claim 1, wherein the machine has a machine frame and wherein a width between an outside edge of said first lower fork and an outside edge of said second lower fork is less than the width of the machine frame.

23. The fork and jaw grapple according to claim 22, wherein said width is less than four feet.

24. The fork and jaw grapple according to claim 23, wherein said width is less than three feet.

* * * * *